US007036851B2

(12) United States Patent
Romig

(10) Patent No.: US 7,036,851 B2
(45) Date of Patent: May 2, 2006

(54) LATCHING SYSTEM FOR SLIDING WINDOW

(75) Inventor: Joel Andrew Romig, Plain City, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/695,525

(22) Filed: Oct. 28, 2003

(65) Prior Publication Data

US 2005/0087992 A1 Apr. 28, 2005

(51) Int. Cl.
*E05C 7/00* (2006.01)

(52) U.S. Cl. ..... 292/24; 292/25; 292/95; 292/96; 292/109; 292/121; 292/122; 292/290; 292/302; 292/DIG. 11; 292/DIG. 20

(58) Field of Classification Search ..... 292/24, 292/25, 32, 33, 95, 96, 121, 122, 137, 157, 292/163, 109, 290, 302, DIG. 20, DIG. 61, 292/DIG. 11, 11, 27, 46, 47, 49
See application file for complete search history.

(56) References Cited

U.S. PATENT DOCUMENTS

| | | | | | |
|---|---|---|---|---|---|
| 244,665 | A | * | 7/1881 | Preston | 292/25 |
| 530,862 | A | * | 12/1894 | Teed | 292/42 |
| 621,574 | A | * | 3/1899 | Kinsey | 292/24 |
| 1,083,173 | A | * | 12/1913 | Zeckhauser | 292/5 |
| 1,143,653 | A | * | 6/1915 | Smith | 70/97 |
| 1,264,814 | A | * | 4/1918 | Kornstein | 70/116 |
| 1,421,197 | A | * | 6/1922 | Ferrara | 70/82 |
| 1,536,268 | A | * | 5/1925 | Rasmussen | 292/25 |
| 1,540,088 | A | * | 6/1925 | Rasmussen | 292/25 |
| 1,574,023 | A | * | 2/1926 | Crompton et al. | 292/24 |
| 2,967,418 | A | * | 1/1961 | Donald | 70/71 |
| 3,181,905 | A | | 5/1965 | Bisbing | |
| 3,214,948 | A | * | 11/1965 | Modrey | 70/99 |
| 3,360,290 | A | * | 12/1967 | De Gray | 292/6 |
| 3,667,793 | A | | 6/1972 | Varrin et al. | |
| 4,124,054 | A | | 11/1978 | Spretnjak | |
| 4,322,914 | A | | 4/1982 | McGaughey | |
| 4,438,965 | A | | 3/1984 | Stearns | |
| 4,489,965 | A | | 12/1984 | Taylor | |
| 4,554,907 | A | * | 11/1985 | Overley et al. | 126/191 |
| 4,695,081 | A | | 9/1987 | Boykin | |
| 4,850,139 | A | | 7/1989 | Tiesler | |
| 4,920,698 | A | | 5/1990 | Friese et al. | |

(Continued)

FOREIGN PATENT DOCUMENTS

GB 2275500 * 2/1994

*Primary Examiner*—Brian E. Glessner
*Assistant Examiner*—Carlos Lugo
(74) *Attorney, Agent, or Firm*—Rankin, Hill, Porter & Clark LLP; Christen Millard

(57) ABSTRACT

A latch system for securing a sliding window to a fixed member, the latch assembly including a latch housing, a catch housing, and a latch assembly. The latch assembly includes first and second latch arms and an actuator. The latch arms are pivotally secured to the latch housing and include first, actuated ends that are disposed within the latch housing and second, latching ends that are disposed outside of the latch housing and received by the catch housing. The actuator is slidably secured to the latch housing and operable to engage the latch arms' actuated ends so as to pivot the latching ends out of engagement with the catch housing and thereby permit the latch housing and the window associated therewith to move relative to the fixed member.

19 Claims, 3 Drawing Sheets

U.S. PATENT DOCUMENTS 4,936,368 A 6/1990 Philbeck et al.
4,961,600 A * 10/1990 Points et al. ..... 292/25
5,028,082 A 7/1991 Kronbetter
5,042,855 A 8/1991 Bennett et al.
5,431,461 A 7/1995 Andersen, III et al.
5,442,880 A 8/1995 Gipson
5,462,323 A 10/1995 Benninger
5,516,162 A * 5/1996 Takaishi ..... 292/37
5,544,924 A * 8/1996 Paster ..... 292/6
5,620,215 A 4/1997 Janeway
5,711,554 A * 1/1998 Brown et al. ..... 292/19
5,715,631 A * 2/1998 Kailian et al. ..... 49/450
5,725,260 A * 3/1998 Eikmeier et al. ..... 292/129
5,775,029 A 7/1998 Buening
5,799,444 A 9/1998 Freimark et al.
5,799,449 A 9/1998 Lyons et al.
5,822,922 A 10/1998 Grumm et al.
5,996,284 A 12/1999 Freimark et al.
6,174,003 B1 * 1/2001 Smart ..... 292/109
6,412,225 B1 7/2002 McManua
6,546,671 B1 * 4/2003 Mitchell et al. ..... 49/185
2002/0093203 A1 7/2002 Moretz
2002/0148163 A1 10/2002 Warner et al.

* cited by examiner

LATCHING SYSTEM FOR SLIDING WINDOW

BACKGROUND OF THE INVENTION

1. Field of the Invention

The present invention is generally directed toward a latch for a sliding window and, more particularly, toward a latching system for closing and locking a rear center window of a manually operated sliding window assembly.

2. Description of Related Art

In many types of vehicles, such as pickup trucks, it is desirable to provide a sliding window in the rear windshield for ventilation purposes. Such sliding windows typically have a latch or lock to secure the sliding window in a closed position and to prevent opening of the sliding window from the outside.

U.S. Pat. No. 5,442,880 is representative of such sliding window latching assemblies, and includes a latch that is disposed on the sliding window's frame, and a latch keeper that is secured on the fixed window's frame. When the latch is secured over the latch keeper, the sliding window is affixed to the fixed window's frame so as to prevent the sliding window from being slidably opened. Unfortunately, it has been found that inward pressure exerted on the sliding window at the latch will cause the sliding window to deform or bow inwardly, thereby disconnecting the latch from the latch keeper and permitting the sliding window to be opened. Naturally, this is not a desirable structure since it permits unwanted entry into the vehicle.

Other latches have been developed to prevent such undesirable unlatching of the window lock. See, for example, U.S. Pat. No. 4,124,054, wherein a clasp-type latch is disposed over adjacent portions of a pair of sliding window units. Unfortunately, with the '054 design, one-handed operation, which is desired for vehicular installations, is difficult. Moreover, operation of the window lock requires movement in directions other than the direction of intended window movement, and makes opening and closing of the windows rather cumbersome.

Therefore, there exists a need in the art for a latching assembly for a sliding vehicle window that is adapted for one-handed operation, and in which the opening and closing operations can be performed intuitively and wherein the window is resistant to being opened from the outside.

SUMMARY OF THE INVENTION

The present invention is directed toward an improved latch assembly for a sliding window that eliminates or reduces the problems encountered in the art. The present invention is further directed toward an improved latch that prevents opening of the window from the outside, and which permits ergonomic one-handed opening and closing of the window by the user.

In accordance with the present invention, a latch system for a slidable window includes a catch housing, a latch housing, and a latch assembly. The catch housing is secured to a fixed member, the latch housing is secured to the slidable window, and the latch assembly is adapted to releasably connect the latch housing with the catch housing.

In further accordance with the present invention, the latch assembly includes a latch arm and a latch actuator. The latch arm has a first, actuated end, an elongated body portion, and a second, latching end. The actuated end is received within the latch housing and the body portion projects from the latch housing such that the latching end of the latch arm is disposed outside of the latch housing. The latch arm is pivotally secured to the latch housing and is biased so as urge the latching end into engagement with the catch housing.

In further accordance with the present invention, the latch actuator is received in the latch housing and is slidably movable in a direction relatively away from the catch housing and against the latch arm's actuated end so as to pivot the latch arm's latching end out of engagement with the catch housing and thereby release the sliding window from the fixed window.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
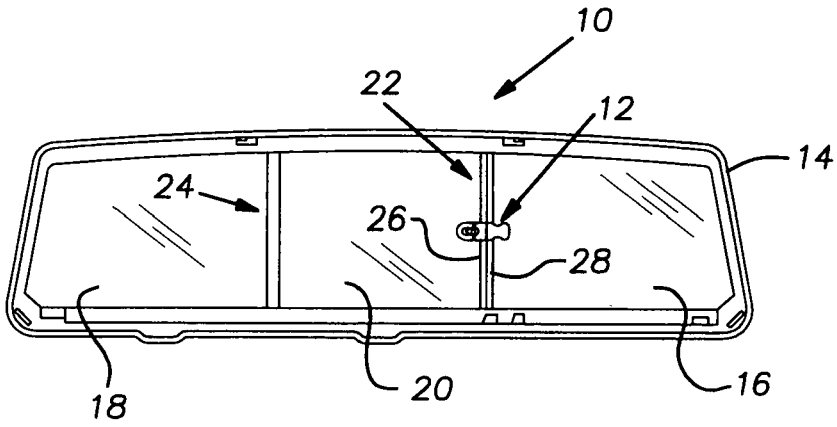
FIG. 1 is a front elevational view of a window unit including a manually operated sliding glass member.

With reference to FIG. 1, a vehicle window unit 10 incorporating a latching system 12 of the present invention is illustrated. The window unit 10 includes a peripheral window frame 14 surrounding a stationary right window 16, a stationary left window 18, and a sliding center window 20. Preferably, the peripheral window frame 14 includes upper and lower tracks (not shown) in which the center window 20 is slidably guided in use.

A first sealing assembly 22 extends along a left-hand edge of the right window 16 and a second sealing assembly 24 extends along the right-hand edge of the left window 18. The sealing assemblies 22, 24 cooperate to provide a watertight seal between the associated edge of the center window 20 and the left and right window 16, 18 when the center window 20 is closed. The first sealing assembly 22, which is associated with the right and center windows 16, 20, has the latching system 12 of the present invention secured thereto, and will be discussed briefly hereinafter as it relates to the present invention. The second sealing assembly 24, which is associated with the left window 18 and the center window 20, is unrelated to the present invention and preferably is generally conventional and, therefore, will not be discussed further hereinafter.

The first sealing assembly 22 includes a center trim piece 26, which is secured over the right-hand edge of the center window 20, and a frame or mullion piece 28, which is secured to the left edge of the right window 16. Preferably, the trim piece 26 includes a mounting portion 26*a* that serves as a raised platform to which a latch housing 32, described hereinafter, is secured.

The trim piece 26 and the frame piece 28 are shaped so as to engage one another in a face-to-face manner, and so as to seal the union between the center and right windows 20, 16 as the center window 20 moves into the closed position. One or more lengths of weather stripping (elastomeric seal material or felt-like fabric seal material, not shown) may be provided by the trim piece 26 and/or frame piece 28 to facilitate sealing therebetween.

For example, the trim piece 26 may be U-shaped in cross-section so as to provide a channel into which the lateral edge of the center window 20 is inserted. Likewise, the frame piece 28 may, in part, provide a U-shaped cross-sectional profile wherein the opening in the "U" is facing toward the center window 20 so as to slidingly and sealingly receive the center window trim piece 26. In this arrangement, seal material disposed on either the trim piece 26 or the frame piece 28 will permit formation of a watertight seal between the trim piece 26 and the frame piece 28. Insofar as it is believed apparent that numerous alternative sealing arrangements are known in the art and may be used interchangeably with that described herein, the present invention is not limited to use in conjunction with the aforementioned window sealing arrangement.

Figure 2:
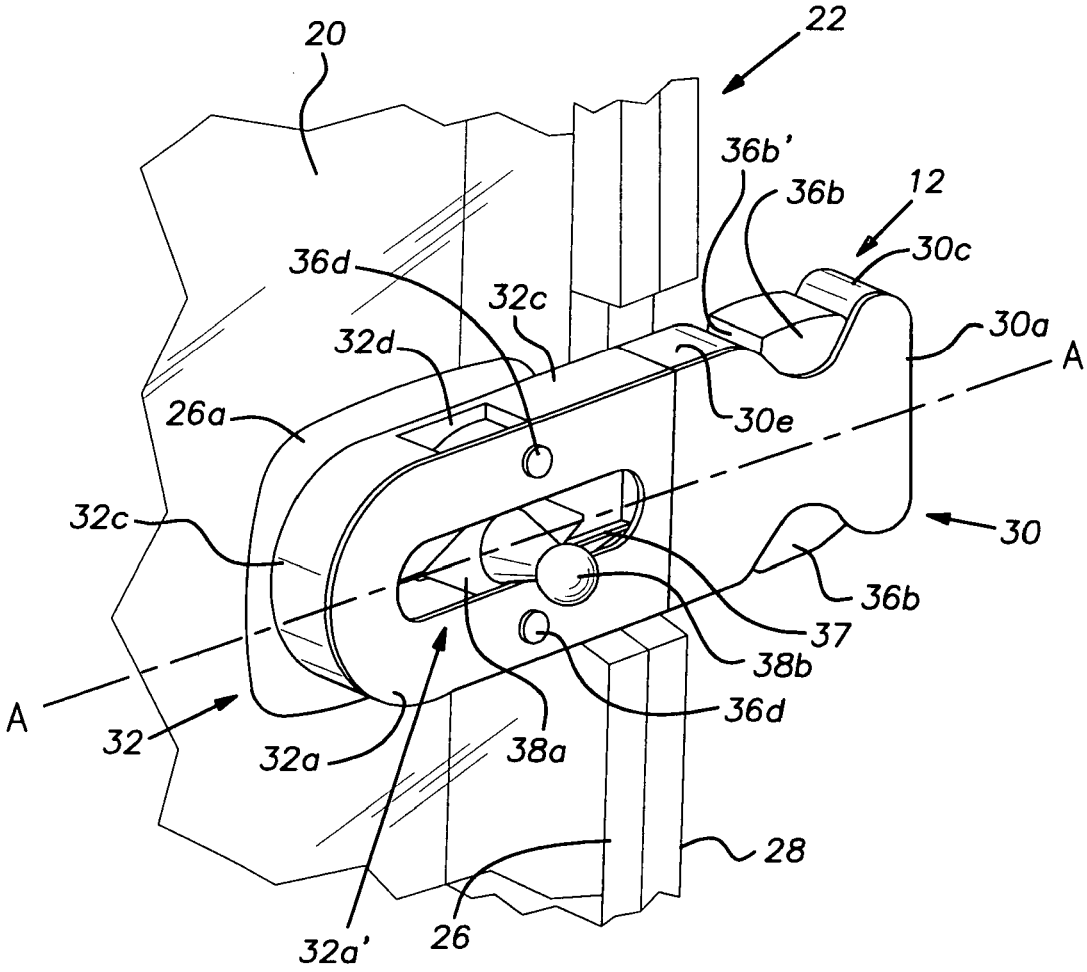
FIG. 2 is an enlarged perspective view of a latching system according to the present invention in a latched condition.
Figure 3:
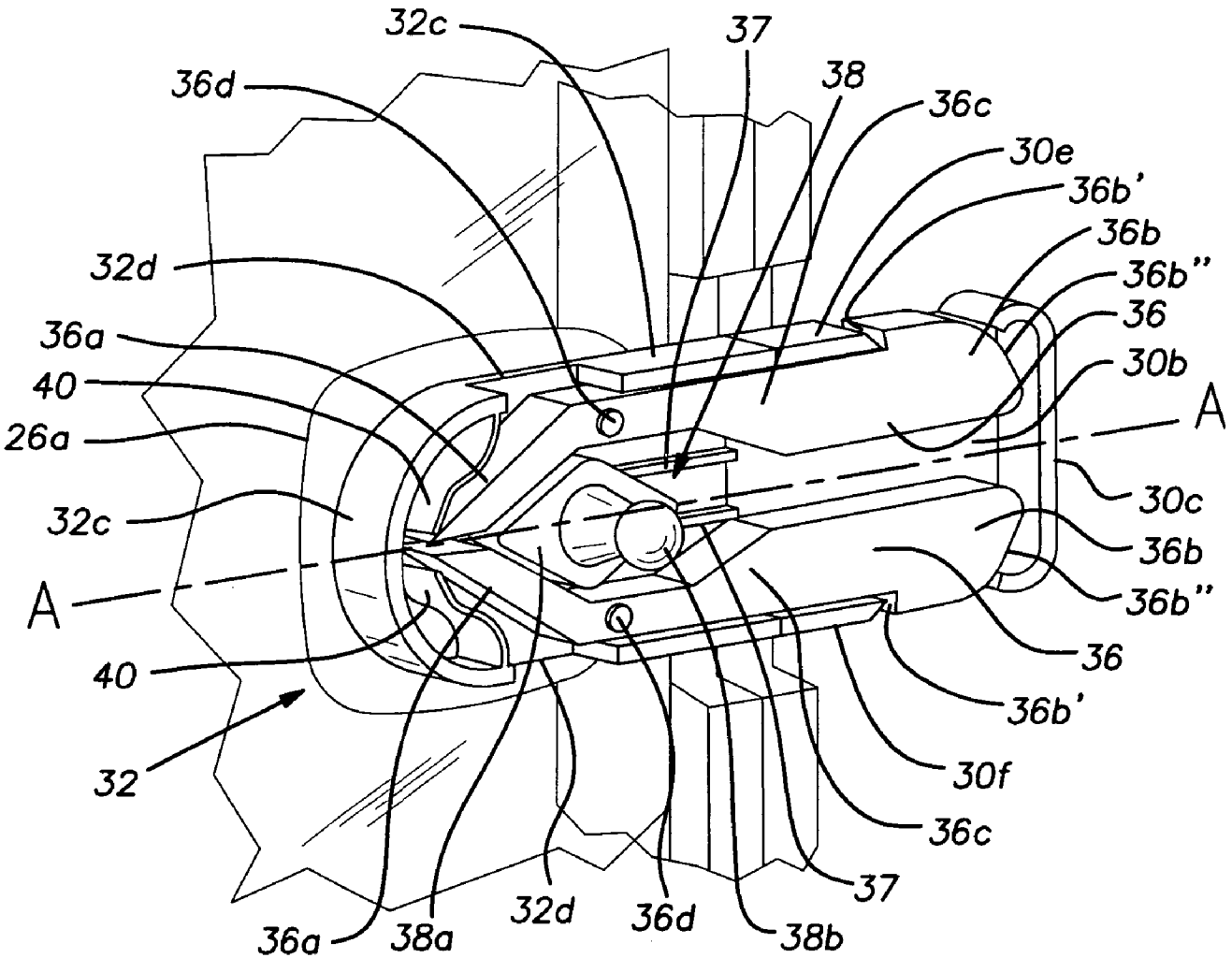
FIG. 3 is view similar to FIG. 2 but with portions removed to more clearly illustrate the latching operation; and, FIG. 4 is view similar to FIG. 3, but with the latching system in an unlatched condition.
Figure 4:
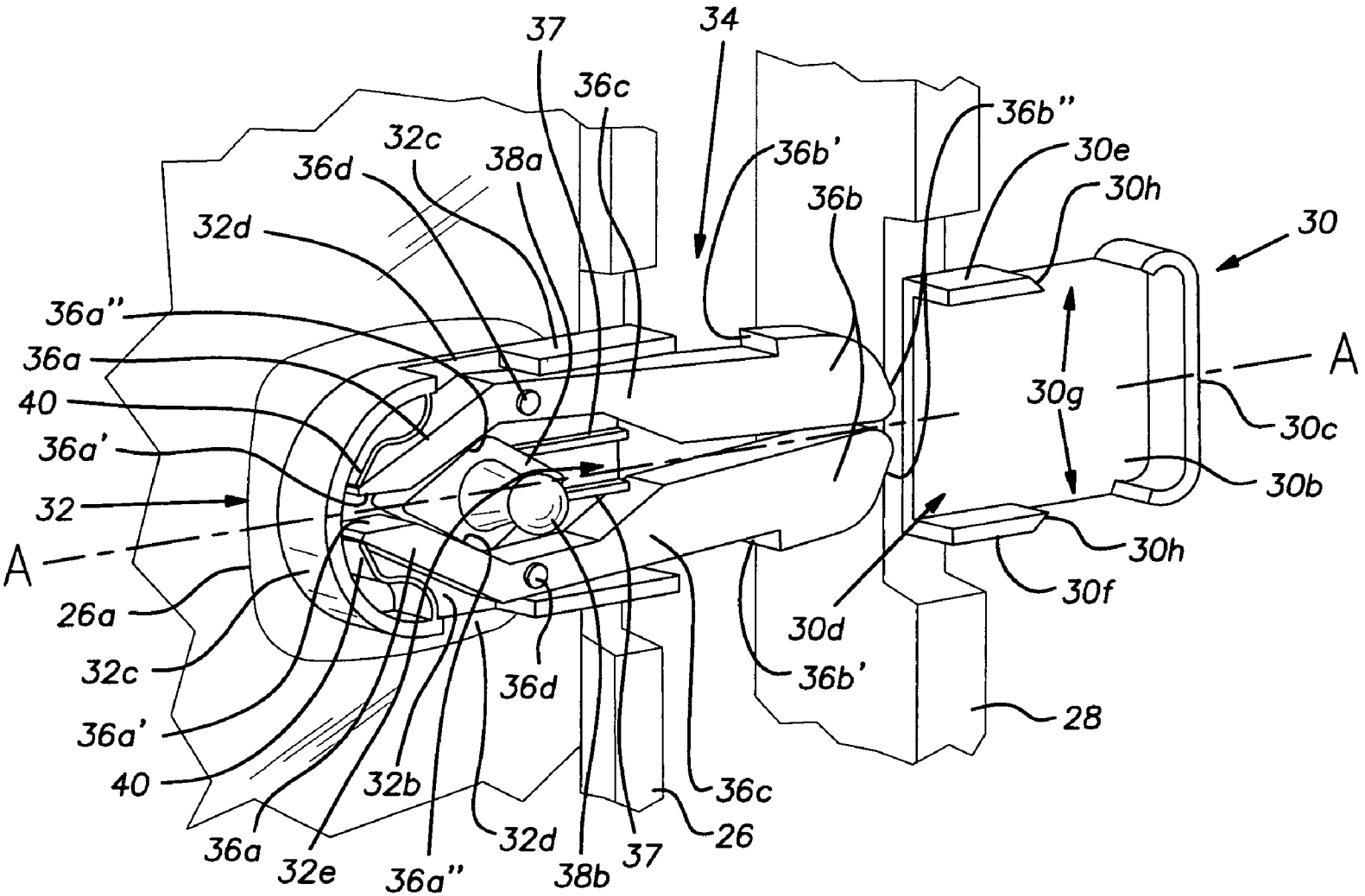

With reference to FIGS. 2–4, the latching system 12 includes a catch housing 30, which is secured to the fixed window frame (i.e., the frame piece 28 of the right window 16), the latch housing 32, which is secured to the movable window frame (i.e., the mounting portion 26*a* of the center window trim piece 26), and a latch assembly 34.

The catch housing 30 is affixed to the frame piece 28, and is preferably integrally molded or formed from an appropriate thermoplastic material. Naturally, the catch housing 30 may be made from metal or other appropriate materials, if desired. The catch housing 30, which defines a generally hollow body, includes solid front and rear walls 30*a*, 30*b*, a solid right end wall 30*c*, an open left end 30*d*, and upper and lower walls 30*e*, 30*f* that have slotted openings 30*g* formed therein. The front, rear, upper, and lower walls 30*a*, 30*b*, 30*e*, 30*f* cooperate to define the opening 30*d* at the left end of the catch housing 30 through which the latch assembly 34, described hereinafter, slidably extends. An edge surface 30*h* defining a portion (i.e., the leftward extent) of each slotted opening 30*g* serves as a latch keeper or engagement surface that receives or engages a portion of the latch assembly 34, as will be apparent from the following discussion. The catch housing 30 may be integrally secured to the frame piece 28 by conventional fasteners (not shown) or may be affixed by conventional plastic joining techniques, such as adhesives or welding (sonic; IR; laser welding), either directly or by use of intermediate joining materials.

The latch housing 32 includes a front wall 32*a*, a rear wall 32*b*, and a sidewall 32*c* that cooperate to define a generally hollow body. The rear wall 32*b* is preferably integrally formed or molded with the sidewall 32*c*. The front wall 32*a* is preferably formed separately from the rear wall 32*b* and sidewall 32*c* and is secured via known welding or adhesive bonding techniques during assembly.

The sidewall 32*c* extends around three sides of the latch housing 32 and, in the illustrated embodiment, has top and bottom openings 32*d* formed therein. The front wall 32*a* has an elongated opening 32*a*' formed through which a portion of the latching assembly 34 extends, as will be apparent from the following discussion. Moreover, in the illustrated embodiment, the front wall 32*a*, rear wall 32*b*, and sidewalls 32*c* cooperate, at the rightward facing end of the latch housing 32, to define an opening 32*e* through which the latch assembly 34 projects. The inner surface of the rear wall 32*b* has a pair of ribs or rails 37 formed thereon that slidably receive and guide a portion of the latch assembly 34, described hereinafter. The rails 37 are preferably spaced equal distances from, and parallel to, the longitudinal axis A—A of the latch system 12. The inner surface of the sidewalls 32*c* also have a pair of integrally formed springs 40, which are provided to bias the latch assembly 34 into a latched condition, described hereinafter.

It is noted that the rightward facing end of the latch housing 32 is generally planar so as to abut the leftward facing end of the catch housing 30 in a face-to-face manner. It is further noted that the leftward facing end of the latch housing 32 is curved so as to provide a clean and unobtrusive exterior appearance. Naturally, the present invention is not limited to the particular ornamental appearance of the latching system 12, and it is contemplated that numerous equivalent geometric variations may be devised with knowledge of the present invention and without departing from the scope and spirit of the present invention.

The latch housing 32 and catch housing 30 are generally symmetrical about the latch system longitudinal axis A—A, which extends lengthwise through the middle of the latch housing 32 and the catch housing 30, as illustrated. As such, the upper and lower halves of the latch housing 32 are generally identical to one another while the upper and lower halves of the catch housing 30 are generally identical to one another. Although this symmetry is preferred for manufacturing, assembly, and aesthetic reasons, it is not mandatory. Rather, it is contemplated that the latching system 12 in accordance with the present invention could be made in an asymmetrical manner and, accordingly, the present invention is not to be limited to the symmetrical arrangement that is preferred and illustrated herein.

The latch assembly 34 includes a pair of arms 36 and an actuator 38. The arms 36 are pivotally secured to the latch housing 32 and project laterally from the latch housing 32 so as to extend into, and be received within, the catch housing 30. The actuator 38 is slidably secured to the latch housing 32 and is accessible via the elongated opening 32*a*' in the latch housing front wall 32*a*. The actuator 38 is operable to move the arms 36 between an engaged position, wherein the arms 36 may be latched to the catch housing 30, and a disengaged position, wherein the arms 36 are unlatched from the catch housing 30, as will be apparent from the following discussion.

The latch arms 36 are generally identical to one another, as illustrated, and each include an angled first portion 36*a* at a first end thereof, an enlarged second portion 36*b* at a second end thereof, an elongated body portion 36*c*, and a pivot pin 36*d*. The elongated body portion 36*c* extends between and interconnects the first portion 36*a* and the second portion 36*b*. The pivot pin 36*d* extends through the body portion 36*c* at a location near the union of the body portion 36*c* and the angled first portion 36*a*, and is rotatably secured to the latch housing front and rear walls 32*a*, 32*b*. When the latch arms 36 are pivotally secured within the latch housing 32, the first portions 36*a* of the latch arms 36 are biased toward engagement with one another by the springs 40, which, as noted previously, are preferably thermoplastic compression springs that are integrally molded with the latch housing sidewall 32*c*.

The springs 40, which urge the latch arms angled first portions 36*a* away from the latch housing sidewall 32*c* and toward one another, may have other configurations or be provided by other means known in the art. For example, the springs may be separately formed and have ends that are received within pockets formed in the angled first portions 36*a* of the latch arms 36 and the housing sidewall 32*c*, respectively.

With reference to FIG. 3, the geometric configuration of the latch arms 36 will be described in more detail hereinafter. The arms 36 are elongated and are generally aligned along the longitudinal axis A—A of the latching system 12, which extends through the latch housing 32 and the catch housing 30 and about which the latch and catch housings 32, 30 are symmetrical, as described hereinbefore. The angled first portion 36*a* of the latch arms 36 provides a surface 36*a*' that faces vertically downwardly (upwardly) and defines a plane that is generally parallel to the axis A—A. From this surface, the latch arm first portion 36*a* extends diagonally (i.e., laterally and vertically) away from the axis A—A so as to provide a lateral surface 36*a*" disposed above (or below) the longitudinal axis A—A and facing toward the longitudinal axis A—A. The springs 40 engage the latch arms first portion 36*a* near the end thereof, as illustrated, so as to have maximum biasing leverage on the latch arms 36. Thereafter, the latch arm 36 extends generally parallel to the axis (albeit with differing height dimensions) so as to define the elongated longitudinally oriented body portion 36*c* interconnecting the angled first portion 36*a* and the enlarged second portion 36*b*.

The latch arms' elongated body portion 36*c* terminates in the enlarged second portion 36*b*, which is disposed at the second end of the latch arm 36. The enlarged second portion 36*b* has a stepped surface 36*b*' at a trailing edge thereof and a curved leading edge 36*b*". The stepped surface 36*b*' faces toward the first end of the latch arm 36 and defines a plane that is generally perpendicular to the axis A—A, as illustrated. The curved leading edge 36*b*" facilitates insertion of the latch arms 36 into the catch housing 30, as will be apparent from the following discussion.

Each pivot pin 36*d* extends through the associated latch arm body portion 36*c* in a direction transverse to the longitudinal axis A—A and is disposed at a location near the intersection with the angled first portion 36*a*, as illustrated. Preferably, each of the latch arms 36 rotate or pivot about the associated pivot pin 36*d* while the pivot pin 36*d* stays generally stationary. Alternatively, each of the latch arms 36 may be integrally affixed to the associated pivot pin 36*d* and the pivot pin 36*d* may be rotatably received within the latch housing front and rear walls 32*a*, 32*b*. In this regard it is noted that several different techniques for securing the pivot pin 36*d* to the latch housing 32 are known in the art and may be used herein. For example, the ends of the pivot pins 36*d* may be simply staked or heat staked to the latch housing 32 so as to help integrate or unify the latch housing front and rear walls 32*a*, 3*b* into a complete, one-piece latch housing assembly, it being noted that the edges of the latch housing front wall 32*a* may also be welded or adhesively secured to the latch housing sidewall 32*c*, as discussed previously.

The actuator 38 is received between the latch arms 36 and is slidably movable within the latch housing 32. Preferably, the actuator 38 includes an actuator body portion 38*a*, a grip or knob portion 38*b*, and a connector portion (not shown). The knob portion 38*b* extends through the elongated opening 32*a*' in the latch housing front wall 32*a*. The connector portion preferably includes a slide (not shown) that is sized and adapted to fit between the rails 37 on the latch housing rear wall 32*b* so as to move laterally relative to the latch housing 32 and parallel to the axis A—A. Accordingly, the actuator 38 is guided and controlled during lateral or longitudinal movement, so as to provide for smooth operation of the actuator during opening and closing of the window 20. Preferably, the actuator body portion 38*a* is closely received between the latch housing front and rear walls 32*a*, 32*b* with little play so as to maintain the actuator 38 in the desired alignment with the latch arms 36.

It is contemplated that the connector portion may be provided in other forms, or that additional elements may be incorporated into the connector portion. For example, the connector portion may be provided by, or supplemented with, a screw (metal/plastic) or post (push-in bayonet-type plastic pin) that extends through a slotted opening or elongated slot (not shown) in the latch housing rear wall 32*b* so as to prevent the actuator body 38*a* from being disassociated with the latch housing 32 while permitting the actuator 38 to slide lengthwise (parallel to the axis A—A) along the slot in a guided fashion and with a predetermined stroke or throw. Likewise, two or more posts and associated slots, disposed on opposite sides of the axis A—A may be provided to prevent the actuator from pivoting or becoming misaligned during use. As will be appreciated from the foregoing, it is considered apparent that further alternative or supplemental means to slidably secure the actuator 38 to the latch housing 32 will be known to those skilled in the art and may be used interchangeably without departing from the scope and spirit of the present invention.

The actuator body portion 38*a* is generally diamond shaped and is manually movable lengthwise by applying a pulling or pushing force on the actuator knob portion 38*b*. Clearly, the present invention is not limited to an actuator 38 having the illustrated shape. However, the peripheral shape of the left end of the actuator body portion 38*a* is preferably closely matched to the orientation of the angled first portion 36*a* of the latch arms 36 and, more specifically, the lateral surface 36*a*" of the angled portion 36*a*, so as to facilitate pivotal movement of the arms 36 against the biasing force of the springs 40.

Accordingly, when the latch arms 36 are in the engaged position (FIG. 3), the actuator body 38*a* may be spaced a short lateral distance from the arms' angled portion 36*a* and slightly out of engagement with the lateral surface 36*a*". However, upon sliding of the actuator 38 (leftward in FIG. 3 along the rails 37 toward the position shown in FIG. 4), the actuator body portion 38*a* engages the lateral surfaces 36*a*" of the angled first portion 36*a* of the latch arms 36, and thereby causes the arms 36 to rotate or pivot about the axis of the pivot pins 36*d* and moves the stepped surfaces 36*b*' provided by the latch arms' enlarged second portions 36*b* out of engagement with the engagement surface 30*h* provided by the catch housing 30. Once the latch arms 36 are free of the engagement surface 30*h*, and assuming that the actuator 38 is in engagement with the left edge of the elongated opening 32*a*' in the latch housing front wall 32*a*, application of further lateral (leftward) force will cause the center window 20 to slide away from the right window 16. Therefore, the present invention permits one-handed unlocking and opening of the sliding center window 20.

When the center window 20 is thus opened, releasing the knob portion 38*b* causes the actuator 38 to move rightwardly under the influence of the springs 40 and thereby permits the latch arms 36 to return to their normal position extending generally parallel to the axis A—A. Thus, there is a period of lost motion in which the actuator 38 slides (rightward in FIG. 4 along the rails 37 toward the position of FIG. 3) relative to the latch housing 32 toward the right window 16, while the latch housing 32 and the center window 20 remains stationary relative to the right window 16. Subsequent force on the knob portion 38*b* in a closing (rightward) direction will first force the actuator 38 to the right end of the elongated slot 32*a*' formed in the latch housing front wall 32*a*. Thereafter, the rightwardly directed lateral force applied to the actuator knob 38*b* causes the latch housing 32 and the center window 20 to move together with the actuator 38 toward the right window 16.

When the center window 20 is almost closed against the right window 16, the second portion 36*b* of the latch arms 36 enters into the opening at the left end 30*d* of the catch housing 30. The curved leading edge 36*b*" provided by the latch arms' second portions 36*b* slidably and cammingly engages the catch housing upper and lower walls 30*e*, 30*f*, causing the second portions 36*b* to move toward one another as the latch arms 36 pivot about the pivot pins 36*d*. The second portions 36*b* slide along the inner surfaces of the catch housing upper and lower walls 30*e*, 30*f* until they snap into the slotted openings 30*g*. As such, the latch housing 32 is in abutting engagement with the catch housing 30, and the stepped surfaces 36*b*' are in engagement with the engagement surface 30*h*, effectively trapping the latch arms 36 in position and preventing further lateral movement of the center window 20.

Insofar as the latch arms' enlarged second portions 36*b* are trapped between the catch housing front and rear walls 30*a*, 30*b*, the latch is protected from being disengaged by inward pushing or deformation of the center window 20, increasing the effectiveness of the latching system at preventing unwanted opening of the center window 20 from outside of the vehicle.

It is noted that, when the latch arms 36 are received within the catch housing 30 such that the latch assembly 32 is in the locked position, the latch arms 36 are close to or in engagement with the latch housing sidewall 32*c* and the catch housing upper and lower walls 30*e*, 30*f*. However, since the location of the pivot pin 36*d*, the intersection of the angled first portion 36*a* with the body portion 36*b*, and the location of the top/bottom openings 32*d* in the latch housing sidewall 32*c* are carefully chosen relative to one another, when the latch arms 36 are pivoted into the disengaged position, a portion of the latch arms 36 (i.e., the intersection of the body portion 36*b* and the angled portion 36*a*) may be permitted to extend through the latch housing openings 32*d*. Naturally, the openings 32*d* in the latch housing sidewall 32*c* that permit the latch arms 36 to pivot may be dispensed with by making the latch housing 32 slightly larger in height dimension than the catch housing 30.

Although the present invention has been described with particularity herein, it is considered apparent that the scope of the invention is not limited thereto. Rather, numerous modifications, improvements, and substitutions of parts may be resorted to without departing from the scope and spirit of the present invention. For example, although the presently preferred latch assembly includes a pair of latching arms that work in tandem, it is contemplated that a single latch arm may be used instead with similar, if not identical, functionality. Further, although the actuator body is shown to be generally diamond-shaped, it is contemplated that many other shapes may be used with equal functionality. Also, it is contemplated that the actuator connector portion may be trapped by the rails so as to form a dovetail-type connection therewith. As such, one or more of the connector portion and rails 37 may be L-shaped in cross-section so as to permit movement of the actuator in only the longitudinal direction.

What is claimed is:

1. A window assembly, comprising:

a fixed member;

a sliding window that is slidably movable relative to said fixed member;

a catch housing secured to the fixed member;

a latch housing secured to the sliding window; and, a latch assembly movably secured to said latch housing and releasably secured to said catch housing, said latch assembly comprising:

first and second latch arms, each of said first and second latch arms being biased into engagement with said catch housing and including a first actuated end, a second latching end, and an elongated body portion extending between said first actuated end and said second latching end;

a first pivot pin extending through the elongated body portion of said first latch arm to pivotally secure the first latch arm to the latch housing;

a second pivot pin extending through the elongated body portion of said second latch arm to pivotally secure the second latch arm to the latch housing and, a latch actuator, said latch actuator being movable relative to said latch housing and into engagement with the actuated ends of said first and second latch arms so as to pivotally move said latch arms about said pivot pins and thereby move the latching ends of said first and second latch arms out of engagement with said catch housing so as to permit said sliding window to be slidably moved away from said fixed member, said latch actuator being slidably secured to said latch housing and movable relatively toward and away from said catch housing.

2. The window assembly according to claim 1, wherein said catch housing includes a rear wall secured to said fixed member, a front wall, an upper wall, and a lower wall, and wherein said front, rear, upper, and lower walls cooperate to define an end opening through which the latch arms extend.

3. The window assembly according to claim 1, wherein said latch housing includes rails that guide the latch actuator as the latch actuator is slidably moved.

4. The window assembly according to claim 1, wherein said latch actuator is disposed between said first and second pivot pins.

5. The window assembly according to claim 1, wherein said first and second latch arms protrude from said latch housing.

6. The window assembly according to claim 1, wherein said catch housing includes upper and lower walls, and where said catch housing upper and lower walls define the slotted openings that receive the latching ends of the first and second latch arms.

7. The window assembly according to claim 1, wherein said latch actuator is slidably secured to the latch housing at a location relatively between said first and second latch arms, and is adapted for linear movement into and out of engagement with the actuated ends of the latch arms.

8. A window assembly, comprising:

a fixed member;

a sliding window that is slidably movable relative to said fixed member;

a catch housing secured to the fixed member, said catch housing including a plurality of walls, and wherein at least two opposing walls of the catch housing define slotted openings;

a latch housing secured to the sliding window; and, a latch assembly movably secured to said latch housing and releasably secured to said catch housing, said latch assembly comprising:

first and second latch arms, each of said first and second latch arms being biased into engagement with said catch housing and including a first actuated end, a second latching end, and an elongated body portion extending between said first actuated end and said second latching end; and, a latch actuator, said latch actuator being slidably movable relative to said latch housing into engagement with the actuated ends of said first and second latch arms so as to pivot said first and second latch arms out of engagement with said catch housing and thereby retract said latching ends from said slotted openings in the catch housing and permit said sliding window to be slidably moved away from said fixed member.

9. The window assembly according to claim 8, further comprising a biasing spring associated with said latch arms and serving to bias said latch arms' latching ends into engagement with said catch housing.

10. The window assembly according to claim 8, wherein each of said first and second latch arms are pivotally mounted to said latch housing via a pivot pin extending through said elongated body portions.

11. The window assembly according to claim 10, wherein said latch actuator is slidably secured to the latch housing at a location relatively between said first and second latch arms, and is adapted for linear movement into and out of engagement with the actuated ends of the latch arms.

12. The window assembly according to claim 11, wherein said catch housing includes a rear wall secured to said fixed member, a front wall, an upper wall, and a lower wall, and wherein said front, rear, upper, and lower walls cooperate to define an end opening through which the latch arms extend.

13. The window assembly according to claim 8, wherein said catch housing includes a rear wall secured to said fixed member, a front wall, an upper wall, and a lower wall, and wherein said front, rear, upper, and lower walls cooperate to define an end opening through which the latch arms extend.

14. A latch assembly for a slidable window, comprising:

a catch housing adapted to be secured to a stationary member and defining an end opening and a pair of opposed slotted openings, each of said slotted openings being at least partially defined by an edge surface;

a latch housing adapted to be secured to the slidable window; and, a latch assembly, said latch assembly being received within said latch housing and being releasably secured to said catch housing, said latch assembly comprising:

first and second latch arms, each latch arm having a first actuated end, an elongated body portion, and a second latching end, wherein said actuated ends are received within said latch housing, said body portions project from said latch housing, and said latching ends are disposed outside of said latch housing, said latch arms being pivotally secured to said latch housing and being biased so as to urge said latching ends through an associated one of said slotted openings and into engagement with said an associated edge surface; and, a latch actuator, said latch actuator being slidably secured to said latch housing and slidably movable, in a direction relatively away from said catch housing, against the actuated end of each latch arm so as to pivot the latching ends of each latch arm out of said slotted openings and out of engagement with said edge surfaces so as to release said sliding window from said fixed window.

15. The latch assembly according to claim 14, wherein said catch housing includes a rear wall secured to said fixed member, a front wall, an upper wall, a lower wall, and an end wall, and wherein said front, rear, upper, and lower walls cooperate to define the end opening through which the first and second latch arms extend and wherein said upper and lower walls define the opposed slotted openings.

16. The latch assembly according to claim 14, further comprising a biasing spring engaged with said actuated ends of said latch arms and serving to bias said latching ends of said latch arms away from each other, through said slotted openings and into engagement with said edge surfaces catch housing.

17. The latch assembly according to claim 14, further comprising a first pivot pin extending through the eleongated body potion of said first latch arm and a second pivot pin extending through the elongated body portion of said second latch arm and wherein said first pivot pin and second pivot pin are received in said latch housing, said first pivot pin defining an axis about which said first latch arm rotates and said second pivot pin defining an axis about which said second latch arm rotates.

18. A method for operating a sliding window, said sliding window being laterally movable between a closed position adjacent a fixed member and an open position spaced from said fixed member, comprising the steps of:

providing a latch housing affixed to said sliding window;

providing a catch housing affixed to said fixed member, said catch housing having a pair of opposed walls that define slotted openings;

providing a latch assembly, said latch assembly being operable to releasably secure said latch housing to said catch housing and including first and second latch arms and a latch actuator, each of said latch arms having an actuated end and a latching end that are interconnected by an elongated body portion, said actuated ends being received within said latch housing while said elongated body portions project from said latch housing such that said latching ends are disposed outside of said latch housing, said latch actuator being slidably secured to said latch housing at a location intermediate said latch arms and being movable laterally relative to said latch housing and said catch housing and against said latch arm actuated end so as to move said latch arm latching end out of engagement with said catch housing, and wherein, when said latching ends are engaged with said catch housing, comprising the sequential steps of:

a) applying lateral force to said latch actuator and thereby moving said latch actuator laterally away from said catch housing while said latch housing remains stationary;

b) engaging said latch actuator with each of the actuated ends of the latch arms and thereby moving said actuated ends relatively away from one another;

c) pivoting each of said latch arms about an axis so as to move each of said latching ends out of engagement with said catch housing; and, d) applying further lateral force to said latching actuator so as to move said window laterally away from said fixed member.

19. The method according to claim 18, wherein when said latching ends of said latch arms are disengaged from said catch housing, comprising the sequential steps of:

e) applying lateral force to said latch actuator so as to move said latch actuator laterally toward said catch housing while said latch housing remains stationary;

f) applying further lateral force to said latch actuator and thereby causing said latch actuator and said latch housing to move laterally toward said catch housing;

g) inserting said latching ends of said latch arms into said catch housing;

h) engaging the latching ends of said latch arms with said catch housing and thereby causing said latching end to slide over an interior surface of said catch housing;

i) snapping the latching ends of said latch arms into the slotted openings formed in said catch housing to thereby engage said latching end with said catch housing.

* * * * *